United States Patent [19]

Hirschfeld et al.

[11] Patent Number: 4,997,076

[45] Date of Patent: Mar. 5, 1991

[54] MERCHANDISE TRANSACTION MACHINE AND SYSTEM WITH EMERGENCY OPERATIONAL MODES

[75] Inventors: Gidoon Hirschfeld; Abraham Shotland, both of Ein Harod Meuhad, Israel

[73] Assignee: I. V. D. M. Ltd., Ein Harod Meuhad, Israel

[21] Appl. No.: 369,864

[22] Filed: Jun. 22, 1989

Related U.S. Application Data

[63] Continuation-in-part of Ser. No. 173,717, Mar. 25, 1988, Pat. No. 4,903,815.

[51] Int. Cl.[5] ..... G07F 7/00

[52] U.S. Cl. ..... 194/212; 221/88; 414/273

[58] Field of Search ..... 194/205, 210, 211, 212, 194/213, 350; 221/21, 87, 88, 89, 134, 191; 414/273; 235/381, 382, 383, 385; 186/55, 56; 364/479

[56] References Cited

U.S. PATENT DOCUMENTS 4,348,152 9/1982 Takomotsu ..... 414/273 X 4,734,005 3/1988 Blumberg ..... 221/88 X

FOREIGN PATENT DOCUMENTS 0249367 12/1987 European Pat. Off. ..... 194/205

0286130 10/1988 European Pat. Off. ..... 194/212

8802524 4/1988 World Int. Prop. O. ..... 221/89

*Primary Examiner*—H. Grant Skaggs

*Assistant Examiner*—Tuan Nguyen

*Attorney, Agent, or Firm*—Fleit, Jacobson, Cohn, Price, Holman & Stern

[57] ABSTRACT

A vending machine having an access port through which articles are delivered and returned in connection with keypad selected transactions performed by a robotic transporter programmed through a computer control system, is provided with an emergency storing bin within which articles are accepted for return only during transaction shutdowns caused by those malfunctions of the robotic transporter which persist after it undergoes a recovery process. Those transactions of the transporter, aborted by failure of a scanner to read identification data on returned articles placed in the access port, may be resumed by selective input of such identification data to the computer control system through the keypad.

15 Claims, 6 Drawing Sheets

MODIFIED NORMAL RETURN MODE

EMERGENCY RETURN MODE

MERCHANDISE TRANSACTION MACHINE AND SYSTEM WITH EMERGENCY OPERATIONAL MODES

BACKGROUND OF THE INVENTION

This invention relates generally to a machine for merchandising manufactured articles or products such as video tape cassettes, as disclosed in prior copending application, Ser. No. 07/173,717, filed March 25, 1988 now U.S. Pat. No. 4,903,815, issued Feb. 27, 1990, with respect to which the present application is a continuation-in-part.

An automatic vending machine within which manufactured articles or products are stored and dispensed therefrom to customers in accordance with coded inputs from a keypad after the machine is enabled by insert of a coded card, is disclosed in the aforementioned prior copending application, the disclosure of which is incorporated herein. Such vending machine involves the recording of transactions, the updating of computer memories, the issuing of receipts, the operation of visual monitors to provide user instruction, as well as other related functions such as credit card validation.

Shutdown of such vending machine occurs as a result of error signals generated in response to malfunctions to prevent customers from returning previously rented products. Customers are thereby not only inconvenienced, but are subjected to increased rental charges because of rental time prolonged through no fault of their own.

It is therefore an important object of the present invention to provide a manufactured article merchandising machine and system through which rental, purchase and article return transactions may be automatically performed together with related transaction accounting operations based on validated customer credit status without penalizing the customer because of machine shutdown as a result of internal malfunction.

It is an additional important object of the present invention, in accordance with the foregoing object, to perform the various merchandising and related functions in a more efficient and convenient manner for the customer by enlargement of the available mode selection options.

SUMMARY OF THE INVENTION

In accordance with the present invention, an automatic vending machine is provided having a cabinet mounting a visual display monitor, a keypad, a magnetic card reading slot, a receipt issuing port and an emergency return port. The machine cabinet also encloses a relatively large transport compartment having two rear wall access doors and two front door assemblies within which transaction storage is provided. One of the front door assemblies also mounts an access port through which articles are returned to and delivered from the machine. The access port unit extends through the transaction storage facility and projects into the transport compartment within which a robotic transporter is mounted. The robotic transporter is operative under programmed computer control to transport articles held in a gripper between a zero reference location and a plurality of storage zones in the transaction storage facility. The transaction storage facility includes at least one storage cell which serves to realign misaligned articles carried by the gripper during transport by the robotic transporter. The transaction storage facility also provides separate space for receiving articles to be discarded or removed from the merchandising process.

The articles received in the access port aforementioned are displaced to positions projecting into the transport compartment for identification code reading purposes. In the case of a video cassette, the identification code is placed thereon for exposure to a code scanner mounted on the gripper device. The code scanner on the gripper is adapted to be aligned with code location on the article projecting into the travel compartment when the gripper is moved to one of a plurality of aligned transaction storage locations. Various code reading functions may thereby be performed in accordance with the computer control program which also dictates other robotic transporter movements.

A collision signal is generated whenever excessive resistance to movement is experienced by the gripper as a result of collision error. Such collision signal is operative to effect a programmed recovery action involving transport of an article carried by the gripper to the aligning location and insertion of the article into the alignment cell followed by transport of the article to another storage zone. If a collision signal is again generated during an attempted insertion of the article into another storage zone, normal computer programmed operations are aborted and any article held by the gripper is then transported by the robotic transporter to the disposal zone in the transaction storage facility for discarding the article therein. Such malfunctions of the machine cause shutdown of its delivery and return mode operations if the recovery process is unsuccessful. When shutdown occurs with respect to normal return mode operations, an emergency return mode is enabled to permit return of articles through the emergency return port aforementioned, rather than the normal access port. Emergency return mode of operation may then be initiated pursuant to instructions displayed on the monitor by code entry through the keypad. The articles so returned are stored in a separate storage bin aligned with the emergency return port and are registered by a sensor and counter to limit the number of emergency returns accepted in accordance with the capacity of the emergency return storage bin.

Where the normal return mode operation is aborted by failure of the scanner to read the identifying code on the article, because of scanner malfunction or code label damage, the customer may enter the identification code for the article, pursuant to displayed instructions, through the keypad to establish a modified normal return mode with the article in the normal transaction access port.

Operation of the machine is also programmed in accordance with service modes for loading and unloading of articles in the transaction storage assemblies as well as for repair of the machine and replacement of components therein. Rear panel access doors provide easy access for repair and servicing of the robotic transporter where opening of the front door assemblies is blocked by installation of the machine providing for convenient front exposure for the ports, keypad and display monitor to customers.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

DETAILED DESCRIPTION OF PREFERRED EMBODIMENT

Figure 1:
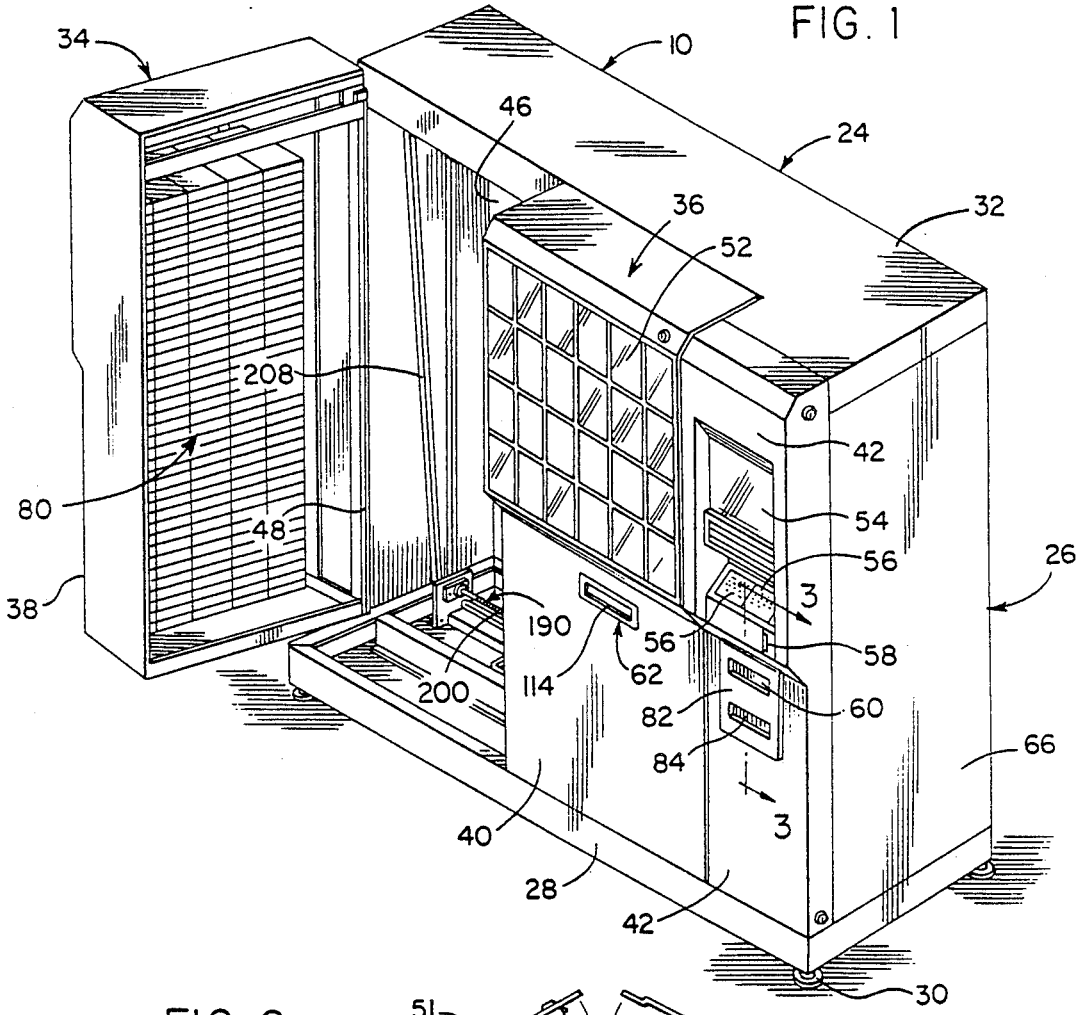
FIG. 1 is a perspective view showing a vending machine constructed in accordance with one embodiment of the present invention, with one of the front door assemblies thereof in an open position.
Figure 2:
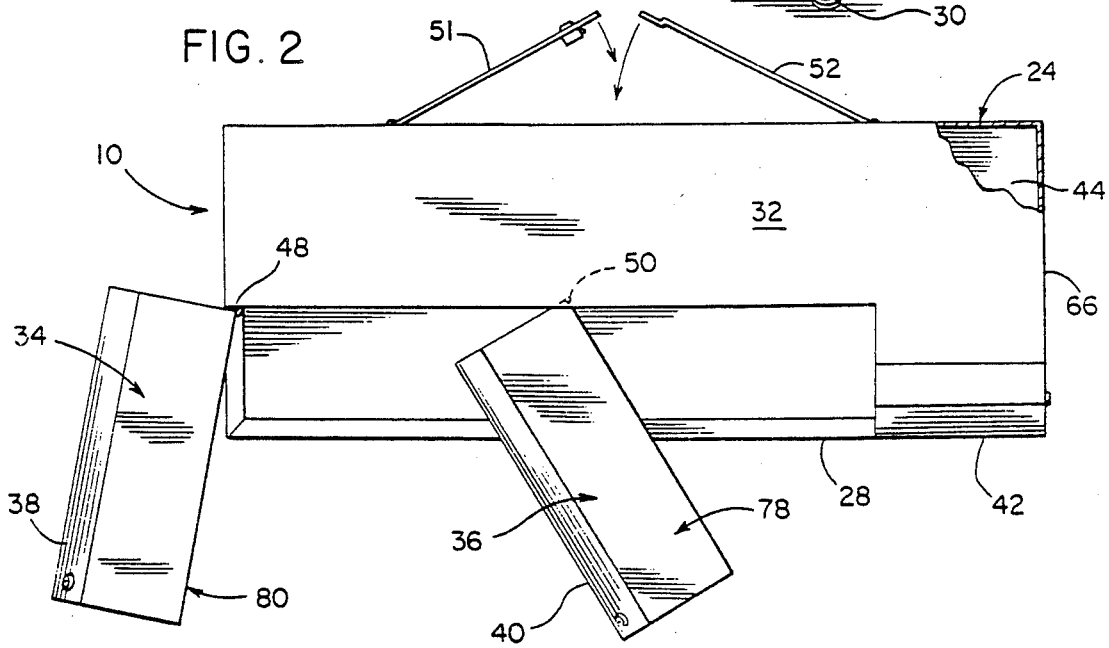
FIG. 2 is a top plan view of the machine shown in FIG. 1 with the front door assemblies and the rear access doors thereof in open positions.
Figure 4:
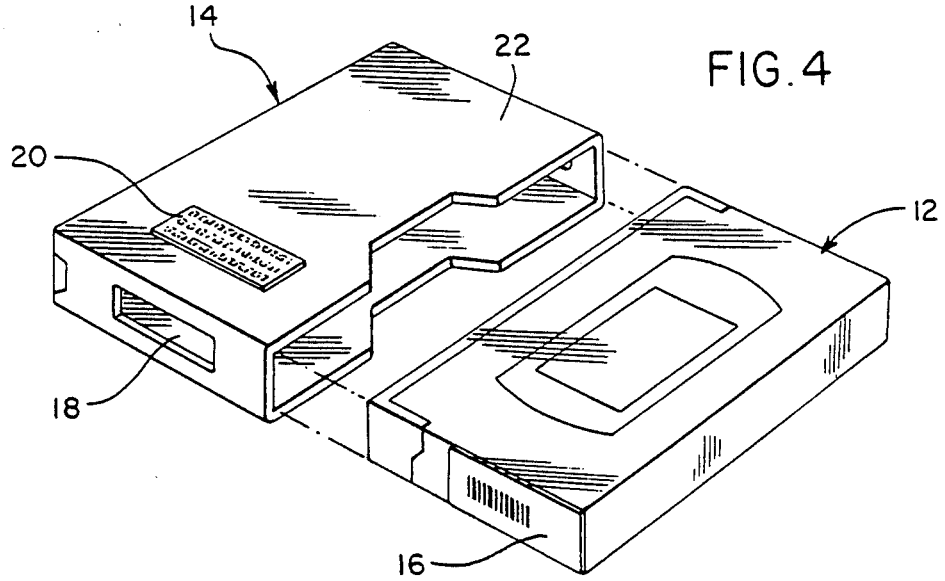
FIG. 4 is a perspective view of a typical video cassette and holder box to be utilized in connection with the machine shown in FIGS. 1–3.

Referring now to the drawing in detail, FIGS. 1 and 2 illustrate a vending machine of the type disclosed in the prior copending application aforementioned now U.S. Pat. No. 4,903,815, generally referred to by reference numeral 10. The machine handles transactions involving video recording cassettes 12 as the merchandising article in accordance with the illustrated embodiment as shown in FIG. 4. The cassette 12 is merchandised within a holder or handling box 14 having scanner readable identification data, in the form of a bar code on strip 16, adhesively attached to opposite longitudinal ends of the cassette extending from one longitudinal side as shown. The bar codes on strips 16 are exposed through openings 18 in the ends of the holder 14 which also has a soft strip 20 adhesively attached to the top thereof with optically readable data imprinted thereon to provide detailed information regarding the article or cassette 12 carried in the holder. The holder is made of a suitable plastic material having a friction surface portion 22 through which the holder is displaced by frictional drive as described in detail in the aforementioned prior copending application now U.S. Pat. No. 4,903,815.

The machine 10 has an outer cabinet structure generally referred to by reference numeral 24 formed by an intermediate housing portion 26 having end walls 66 supported on a base portion 28 having level adjusted feet 30 as shown in FIG. 1. The top of the cabinet structure is closed by a roof portion 32. While the base portion 28 is substantially rectangular, the top portion 32 is generally L-shaped to accommodate two front door assemblies 34 and 36. In the closed positions of the door assemblies, the front door panels 38 and 40 thereof are substantially flush with the front panel 42 closing a control compartment 44 on the right side within the cabinet as viewed in FIG. 2. The door assemblies 34 and 36, themselves substantially seal a common travel or transport compartment 46 within the cabinet. The left hand door assembly 34 is pivotally mounted by a hinge 48 on the left end of the intermediate housing portion of the cabinet while the door 36 is pivotally mounted by the base and roof portions 28 and 32 of the cabinet along hinge axis 50 so that both door assemblies swing open in clockwise directions as shown in FIG. 2 to expose the travel compartment 46. The travel compartment may also be opened to expose internal components of the machine for servicing purposes by opening of two rear panel doors 51 and 52.

The front panels 38 and 40 of the door assemblies have forwardly projecting sections mounting a plurality of posters 53 displaying information on the contents of the video cassettes available for rental or purchase. The front panel 42 closing the control compartment 44 at the right side of the cabinet mounts the screen of a visual display monitor 54 through which instructional data and other information is displayed to the user or servicing personnel. A keypad 56 is disposed below the visual display 54 for entry of operational mode selection data and code identifying data as will be described hereinafter. Machine enabling inputs are entered by insertion into a vertical slot 58 of credit or service identification cards containing magnetically readable validating data. A printed receipt delivery port 60 is mounted on the panel 42 below the keypad 56 and card slot 58. A transaction access port 62, having a frame port opening 114, is mounted on the front panel 40 of the door assembly 36 below the display posters 53.

The control compartment 44 of the cabinet encloses the visual display monitor 54 which is electronically connected to a programmed computer control system 64 as disclosed in the prior copending application aforementioned now U.S. Pat. No. 4,903,815, to which the keypad 56 is connected. The computer control system includes a computer and a motor controller to which the computer is electrically connected. The control compartment also houses a journal printer to record transactions performed by the machine 10 and a receipt printer through which transaction receipts are imprinted under control of the computer system 64. Severed print-out receipts are ejected by the receipt printer into the receipt delivery port 60 aforementioned.

Figure 3:
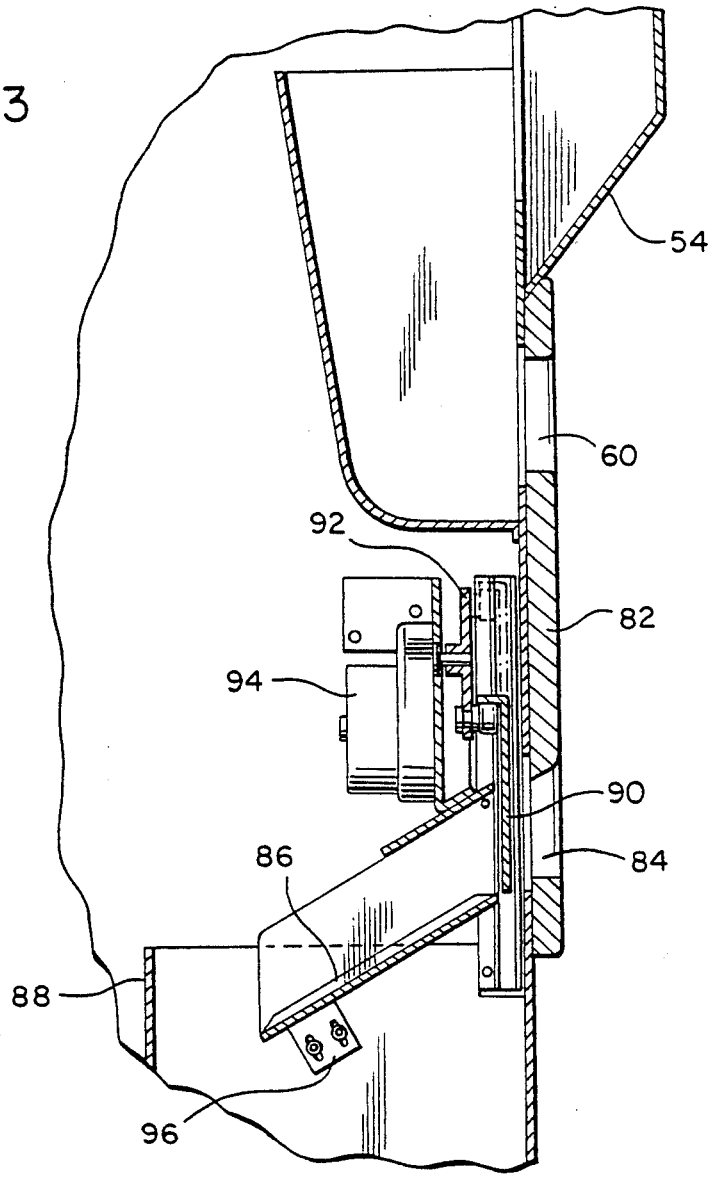
FIG. 3 is an enlarged partial section view taken substantially through a plane indicated by section line 3–3 in FIG. 1.

As shown in FIG. 3, the receipt delivery port 60 is exposed through its opening in plate 82 above an opening 84 of an additional port fixedly mounted by the cabinet in alignment with the upper end of an emergency port chute 86 extending downwardly at an angle into the upper end of an emergency return storage bin 88. The emergency port opening 84 is shown normally closed by a door plate 90 connected by a crank pin operating linkage 92 to a drive motor 94. The motor 94 is energized to upwardly displace the door plate 90 to open the emergency port in an emergency return mode of operation as will be explained in detail hereinafter. A sensor 96 detects deposit of returned articles onto the chute 86 of the emergency return port.

The article access port 62, hereinbefore referred to, is substantially coplanar with the emergency port in the closed position of front door assembly 36 and projects inwardly from its front panel 40 through a section 78 of the transaction storage facility mounted on the inside of door assembly 36. The storage section 78 is similar to the storage section 80 mounted on the other door 34 as shown in FIG. 1, except for the extension of the port 62 therethrough into the travel compartment 46. The construction and arrangement of the storage sections 78 and 80 and cooperating components of the machine are described in detail in the aforementioned prior copending application now U.S. Pat. No. 4,903,815.

When the cassette holder 14 is held in a data reading position, it is adapted to be returned to the transaction storage by a robotic transporter system generally referred to by reference numeral 190 including a linear driving screw shaft 200 and a drive belt 208, located within the compartment 46 as shown in FIG. 1 and described in detail in the aforementioned prior copending application now U.S. Pat. No. 4,903,315. The transporter system as diagrammed in FIG. 5, transports the articles held by the gripper 270 between the transaction storage 98 and access port 62. A malfunction signalling device 320 is associated with the gripper to register, for example, a collision caused by the erroneous delivery of an article to a storage zone already occupied. When an excessive resistance to movement of the gripper is experienced because of a collision, the collision error signal is generated. Also carried by the gripper device 270 is a bar code scanner 338 as diagrammed in FIG. 5. The scanner is supported by the gripper closely spaced from the transaction storage 98 or port 62 for reading of the bar code on strip 16 of a cassette. The scanner 338 is spring-biased and retracted from its bar code reading position relative to the gripper 270 by engagement with a suitable abutment element when the gripper 270 is advanced to an article-clamping position and the article is clamped to the gripper 270 for transport by robotic transporter 190 between locations aligned with the access port 62 and the transaction storage 98 which includes the storage zones in storage sections 78 and 80, a realignment zone and a disposal zone as disclosed in FIGS. 18–23 of the aforementioned prior copending application now U.S. Pat. No. 4,903,815. Such operations of the transporter 190 are under control of the programmed computer control system 64 which includes the computer and motion controller aforementioned. The control system receives inputs from its memory, from the identification scanner 338 and error recovery feedback 100 from the transport system 190 through the malfunction signal device 320. Inputs to the control system are also received from the keypad 56 for selection of the programmed operational mode of machine 10 as diagrammed in FIG. 5. Data outputs from the control system 64 are supplied to the visual display monitor 54 and the printers as aforementioned.

Figure 5:
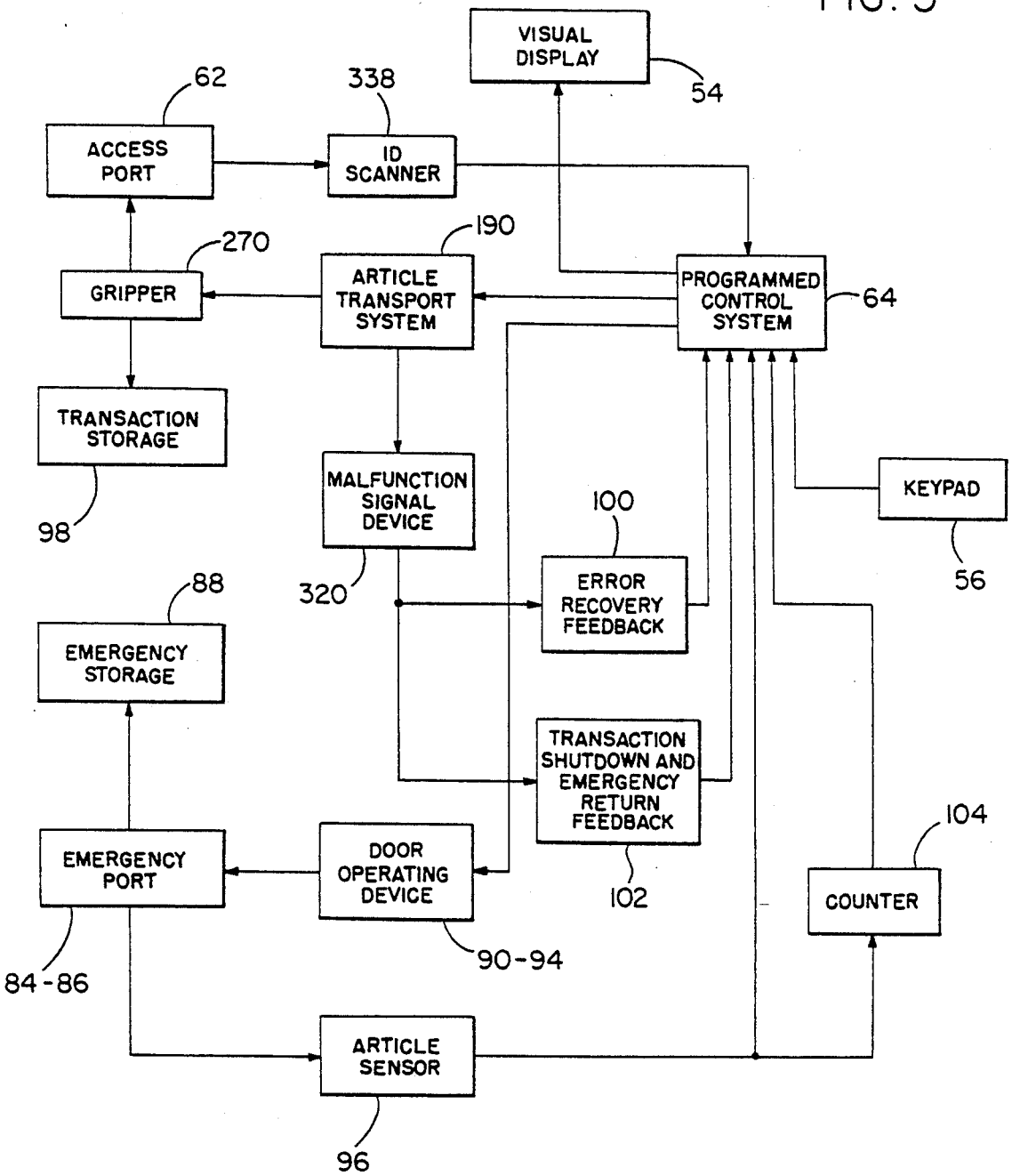
FIG. 5 is a functional block diagram showing interrelationships between various mechanical and control components of the machine.

In accordance with the present invention, the emergency return mode of operation aforementioned is selectively initiated after transaction shutdown by code entry through the keypad 56, when the control system 64 is so enabled by malfunction error feedback 102 from the transport system 190, as diagrammed in FIG. 5, reflecting repeated collisions preventing normal return mode of operation through the access port 62 despite ensuing error recovery actions. When the emergency return mode is initiated, the door operating section 90–94 opens the emergency port 84–86 so that the customer may deposit an article for return to the separate storage bin 88. The returned articles entering the emergency storage bin 88 are detected by sensor 96 to supply a signal to the control system 64 for completing the emergency return mode of operation and to register an increase in the count of the number of articles stored in storage bin 88 through counter 104. The total count from counter 104 is applied to the control system 64 so as to prevent subsequent initiation of an emergency return mode when a predetermined number of articles are accumulated in storage bin 88, representing its maximum capacity.

The operational capability of the computer control system 64 as diagrammed in FIG. 5 is also enlarged in accordance with the present invention to accept an article identifying code input from the keypad 56 in the event the identification code scanner 338 fails to read the identifying code on an article placed by a customer into the access port 62 which ordinarily initiates a normal return mode of operation. Such return mode of operation is aborted by such reading failure of the scanner 338. Selective input of the identification code by the customer through the keypad 56 will accordingly resume such aborted return mode operation to complete the transaction in an otherwise normal fashion without resort to the emergency return mode operation aforementioned.

Figure 6:
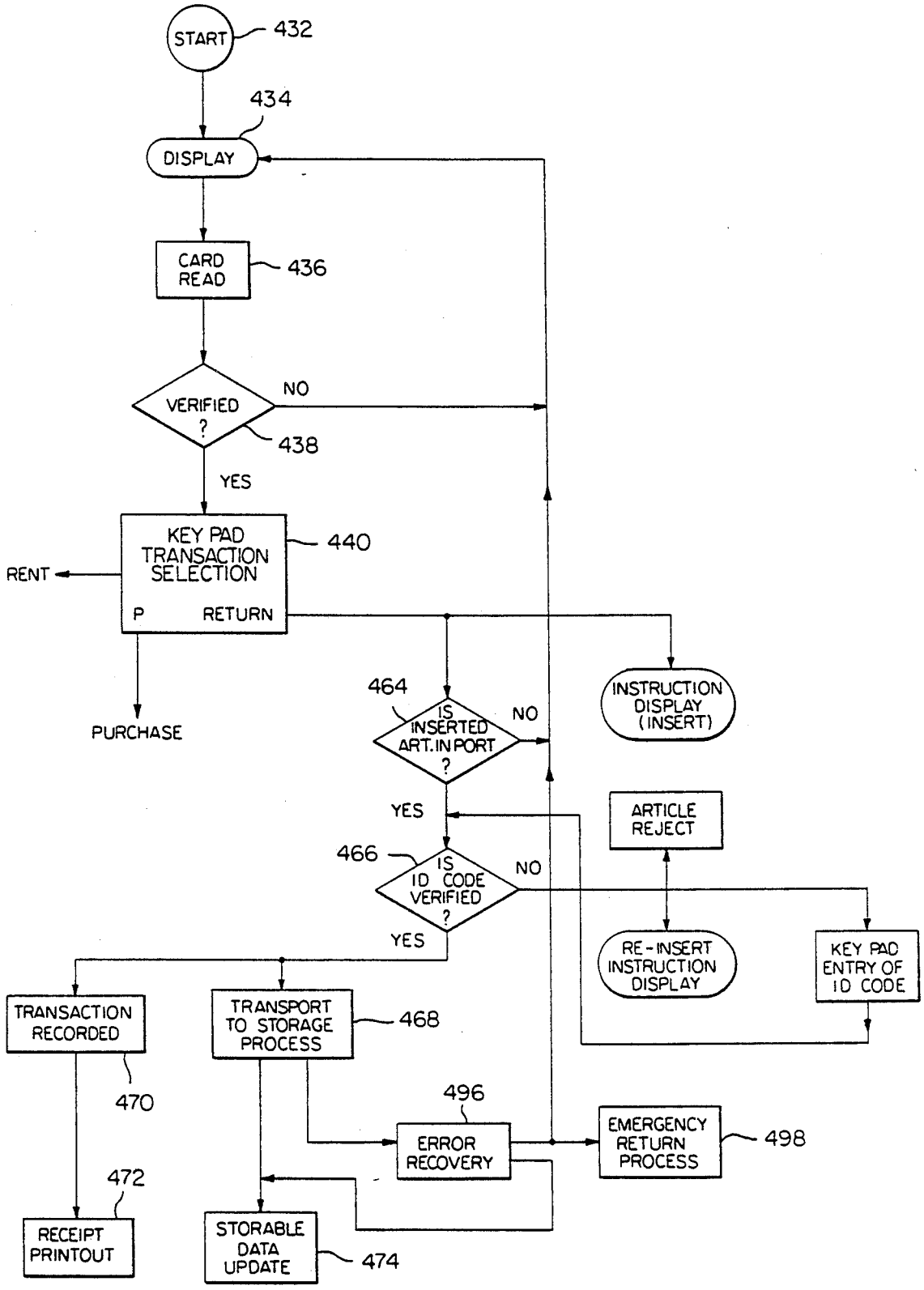
FIG. 6 is a program flow chart diagramming the normal return mode of operation modified in accordance with the present invention.

The machine 10 is activated through its computer control system 64 as denoted at 432 in the program flow chart of FIG. 6, by insertion of a magnetic credit card through slot 58 resulting in a step-by-step instructional display function 434 on the screen of the video monitor 54. Article selection is then made by the user from the information on the posters 52 as shown in FIG. 1. A credit card reading function 436 is then performed as shown in FIG. 6. If the credit card is validated, the software function 438 enables the keypad 56 so that the user may enter selection code commands as denoted at 440. Rental or purchase modes may be initiated on command as described in detail in the aforementioned prior copending application now U.S. Pat. No. 4,903,815.

A return mode of operation is initiated pursuant to instruction display 442 by insertion of the article into the access port 62 as detected in step 464 of the program, following coded command from the keypad. The access port is then closed by its shutter and the gripper is moved to the scanning position for reading of the ID bar code on strip 16 by means of scanner 338 as aforementioned. When the bar code ID is verified as denoted at 466, the article is clamped by the gripper for transport to the closest empty storage zone of transaction storage 98 in a return transport process program denoted by 468 in FIG. 6. The return status of the accepted article is computed at the same time and recorded as indicated at 470 followed by print-out of a receipt at 472. Also, upon completion of the return transport process 468, the computer memory is updated as indicated at 474.

As diagrammed in FIG. 6, a recovery process program 496 may be initiated in response to signals generated by the aforementioned collision signalling device 320 during the transport processes. If the recovery process is unsuccessful, then an emergency return process program 498 follows. The programmed recovery process as diagrammed in FIG. 7 begins with a recovery process start 500 in response to a collision signal. A command is then generated in the computer control system to maintain the gripper in its open or closed condition existing prior to collision as denoted at 502 followed by transporter reset operation 504. If the transporter thereby displaces the gripper to the zero reset position as indicated at decision block 506 in FIG. 7, and an article is present in the gripper as denoted at decision block 508, a transport realignment operation 510 ensues followed by a scanning operation 512 to read the identification code on the article in the alignment cell. If the ID code is recognized at 514, the article is transported to one of the zones in the transaction storage as indicated at 516. Otherwise the article is transported to the discard zone as indicated at 518 in FIG. 7.

Figure 7:
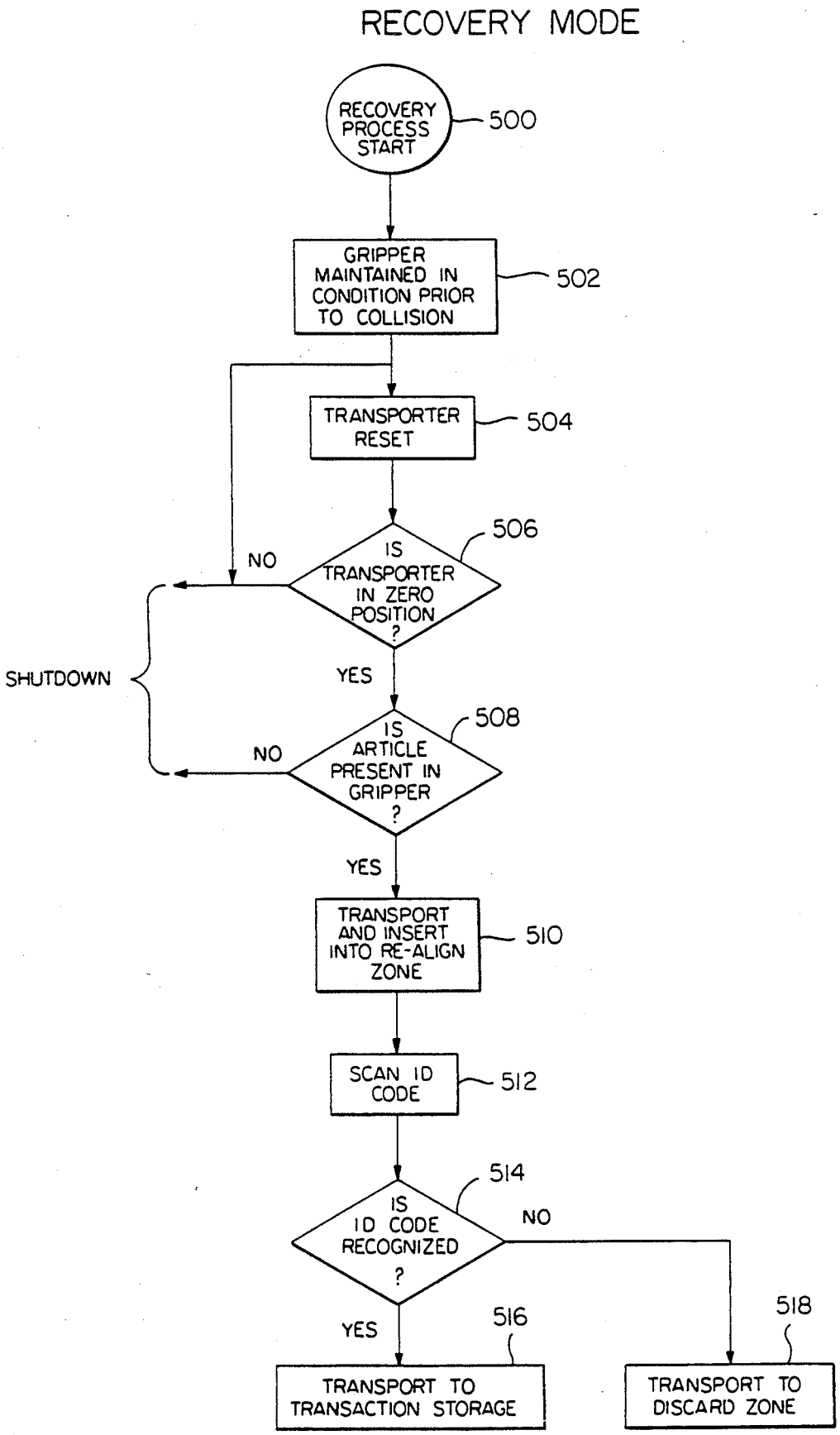
FIG. 7 is a program flow chart diagramming an error recovery mode of operation in accordance with the present invention.
Figure 8:
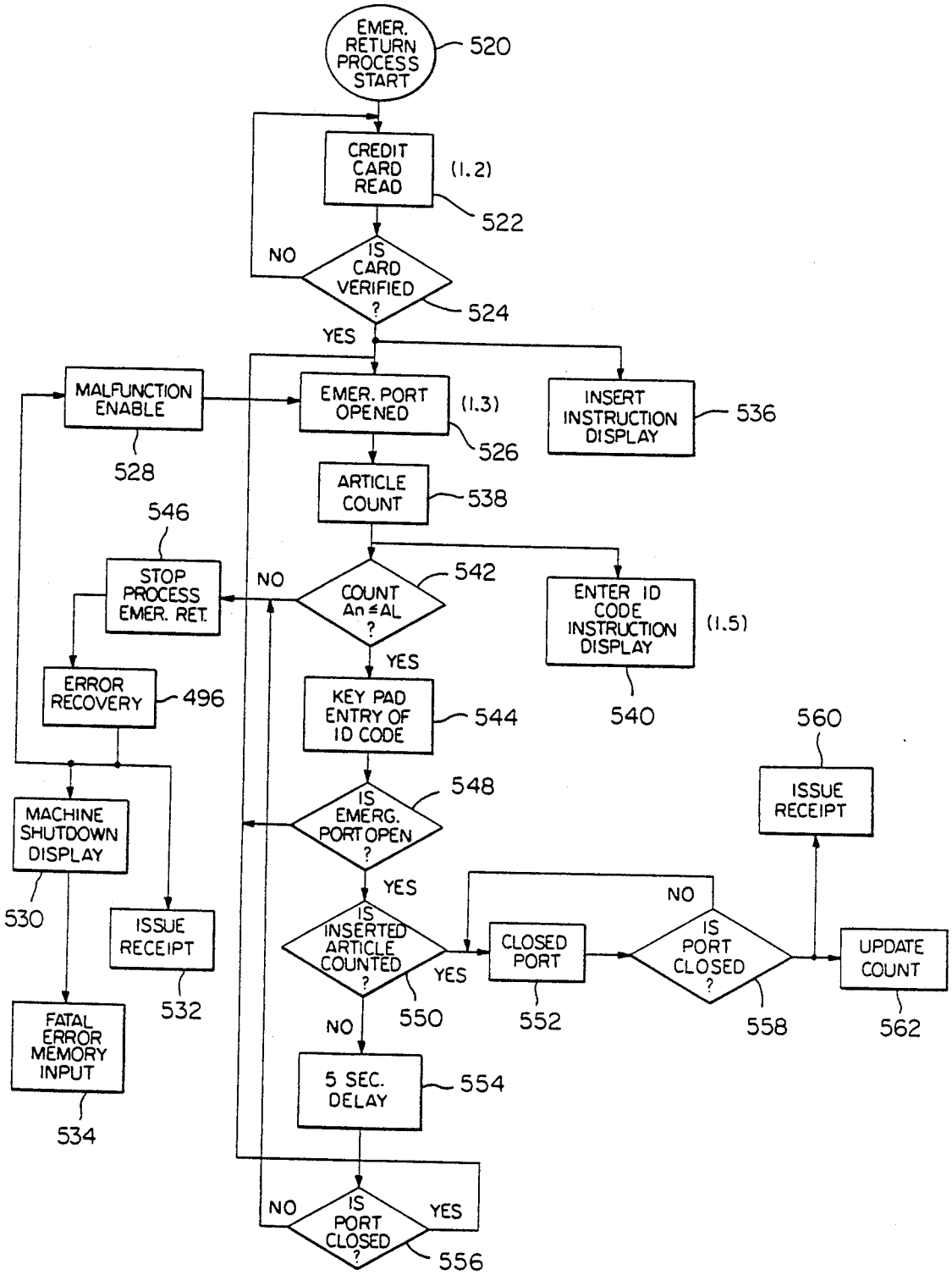
FIG. 8 is a program flow chart diagramming an emergency return mode of operation in accordance with the present invention.

If the recovery process as diagrammed in FIGS. 6 and 7 is unsuccessful in connection with the normal or modified normal return mode, the emergency return process is selectively enabled as diagrammed in FIG. 8. The emergency return mode program as diagrammed in FIG. 8 is initiated at start 520 by user insertion of a credit card into slot 58 resulting in card reading operation 522. If the card is verified at decision block 524, the emergency port 84–86 is opened by operation 526 of the door motor 94 enabled at 528 by the control system following an unsuccessful recovery process 496, as aforementioned, accompanied by transaction shutdown display 530 and receipt issuance 532, as well as an error input 534 to the computer memory.

Upon opening of the emergency return port, an instruction display 536 is produced as diagrammed in FIG. 8, pursuant to which an article is inserted into the open port producing a count operation 538 and display 540 of instructions to enter the article ID code through the keypad 56. Also, if the count total ($A_n$) is equal to or less than the limit value ($A_l$), as denoted in decision block 542, keypad entry is transmitted at 544 to continue with the emergency return program. Otherwise, the emergency return program is aborted as indicated at 546 and the recovery process program 496 initiated again.

The emergency return program is resumed or continued if the emergency port is open as denoted at decision block 548 by counting of the inserted article. If the counting operation is successful, as denoted in decision block 550, a port closing operation 552 is initiated. Otherwise, the condition of the port is monitored after a 5 second delay 554 to determine at 556 if the port is closed. If the port is open, the process is aborted. If the port is closed following the closing operation 552 during continued emergency return operation as determined at 558, completion of the emergency return process is reflected by issuance of a receipt as indicated at 560 in FIG. 8 and the count is updated as denoted at 562.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In a machine for storing, dispensing and returning articles, including means for storing the articles, a transaction port through which the articles are delivered and returned, a scanner, robotic means for transport of the articles between the transaction port and the article storing means during an operational mode, gripper means carried by the robotic means for releasably holding the articles during said transport between the transaction port and the storage means, the scanner being movably mounted on the gripper means for limited displacement thereon to identify the articles within the transaction port and the storing means, means responsive to failure of the scanner to identify the articles for aborting operation of the robotic means during said operational mode thereof, a keyboard and means responsive to selective entry through the keyboard of identifying data corresponding to the articles in the transaction port for resuming the aborted operation of the robotic means.

2. The combination of claim 1 including additional storage means for separately storing the returned articles and means selectively enabled through the keyboard for accepting return of the articles to the additional storage means in response to transaction shutdown of the robotic means.

3. In a machine for storing, dispensing and returning articles, including first article storage means for storing the articles, a transaction port through which the articles are delivered and returned, scanner means for identifying the articles within the transaction port during an operational transaction mode, robotic means for transport of the articles between the transaction port and the first article storage means during an operational mode, gripper means carried by the robotic means for releasably holding the articles during transport between the transaction port and the first article storage means, means for detecting a transaction shutdown during transport of a returned article by the robotic means between the transaction port and the first article storage means, so that the robotic means cannot position the returned article in the first article storage means, additional second storage means for separately storing the returned articles when one of said transaction shutdowns is detected, a keyboard, and means selectively enabled through the keyboard for accepting return of the articles to the additional second article storage means upon detection of one of said transaction shutdowns by said detecting means.

4. In a machine for storing, dispensing and receiving articles, including a transaction port through which said articles are delivered and returned during normal delivery and return modes, transaction storage means within which the articles are received from said transaction port in the normal return mode, robotic means for transporting the articles between the storage means and the transaction port in said normal modes, detection means responsive to malfunction of the robotic means during said normal modes for generating error signals and programmed control means responsive to said error signals for operating the robotic means in a recovery mode tending to restore operation of the robotic means to said normal modes, the improvement residing in handling return of the articles in an emergency return mode, including emergency storing means separate from the transaction storage means for receiving the articles and selectively operable means enabled by failure to restore operation to said normal return mode for accepting said return of the articles during the emergency return mode to the emergency storing means.

5. The improvement as defined in claim 4 including means for detecting and counting the articles returned to the emergency storing means, said programmed control means being operatively connected to the detecting and counting means for preventing said acceptance of returned articles in said emergency return mode in response to storage of a predetermined number of the articles within the emergency storing means.

6. The improvement as defined in claim 5 wherein the emergency storing means includes an additional port through which the articles are returned during the emergency return mode and power operated door means for controlling opening of the emergency storing means through the additional port.

7. The combination of claim 6 including scanner means for identifying the articles in the transaction port.

8. The improvement as defined in claim 7 including means responsive to failure of the scanner means to identify the articles in the transaction port for aborting the normal return mode of operation of the robotic means and means responsive to selective entry of identifying data corresponding to the articles in said transaction port for resuming the aborted operation of the robotic means in the normal return mode.

9. The improvement as defined in claim 4 wherein the emergency storing means includes an additional port through which the articles are returned during the emergency return mode and power operated door means for controlling opening of the emergency storing means through the additional port.

10. The improvement as defined in claim 9 including scanner means for identifying the articles in the transaction port, means responsive to failure of the scanner means to identify the articles in the transaction port for aborting the normal return mode of operation of the robotic means and means responsive to selective entry of identifying data corresponding to the articles in said transaction port for resuming the aborted operation of the robotic means in the normal return mode.

11. The improvement as defined in claim 4 including a cabinet enclosing a travel compartment within which the robotic means is located, at least one front door assembly hingedly connected to the cabinet on which the transaction storage means and the transaction port are mounted for exposure to the travel compartment in a closed position thereof, and access door means mounted on the cabinet in rearwardly spaced relation to the front door assembly for selectively opening the travel compartment to expose the robotic means and the transaction storage means in the closed position of the front door assembly.

12. The improvement as defined in claim 11 wherein the emergency storing means includes an additional port fixedly mounted by the cabinet in substantially coplanar relation to the transaction port in the closed position of the front door assembly.

13. The improvement as defined in claim 3 including scanner means for identifying the articles in the transaction port, means responsive to failure of the scanner means to identify the articles in the transaction port, for aborting the normal return mode of operation of the robotic means, and means responsive to selective entry of identifying data corresponding to the articles in said port for resuming the aborted operation of the robotic means in the normal return mode.

14. In combination with a machine having means for transport of products between storage and access locations, code reading means for generating operational enabling data, a keyboard, sensor means monitoring operation of the transport means for generating motion control data, a computer control system connected to the sensor means and the code reading means for operation of the transport means in response to entry of said enabling data and the motion control data, connecting means connecting the keyboard to the control system for programming said operation of the transport means in selected operational modes, emergency means for separately storing the products returned to the machine, and means responsive to the motion control data generated by the sensor means reflecting malfunction of the transport means for disabling the transport means through the control system while enabling said return of the products to the emergency storing means.

15. In a vending machine including a cabinet enclosing a travel compartment having at least one front door assembly, means pivotally mounting the door assembly for displacement between an open position and a closed position substantially sealing the travel compartment, an access port mounted in the front door assembly and extending therefrom into the travel compartment, transaction storage means mounted by the front door assembly for exposure to the travel compartment, robotic transport means operatively mounted within the travel compartment for transporting articles between the access port and the transaction storage means, emergency port means fixedly mounted by the cabinet in substantially coplanar relation to the access port for accepting return of the articles only during transaction shut-down of the robotic transport means and additional door means mounted by the cabinet in rearwardly spaced relation to the front door assembly for selective access to the travel compartment exposing the robotic transport means and the transaction storage means in the closed position of the front door assembly.

* * * * *